US008327462B2

(12) United States Patent
Feldman et al.

(10) Patent No.: US 8,327,462 B2
(45) Date of Patent: Dec. 11, 2012

(54) DEVICE FOR DISPERSING AND DAMPENING IMPACT FORCES

(75) Inventors: Vladimir Feldman, Lyndhurst, OH (US); Leonid Miroshnik, Beer-Sheva (IL); Eli Gunzburg, Beachwood, OH (US)

(73) Assignee: Panoply Industries LLC, Beachwood, OH (US)

( * ) Notice: Subject to any disclaimer, the term of this patent is extended or adjusted under 35 U.S.C. 154(b) by 219 days.

(21) Appl. No.: 12/743,723

(22) PCT Filed: Nov. 13, 2008

(86) PCT No.: PCT/US2008/083367

§ 371 (c)(1),
(2), (4) Date: May 19, 2010

(87) PCT Pub. No.: WO2009/097038

PCT Pub. Date: Aug. 6, 2009

(65) Prior Publication Data

US 2010/0251451 A1 Oct. 7, 2010

Related U.S. Application Data

(60) Provisional application No. 60/989,237, filed on Nov. 20, 2007.

(51) Int. Cl.
*F41H 1/02* (2006.01)

(52) U.S. Cl. ..... 2/2.5; 2/463; 2/464; 2/465; 2/466; 2/467; 2/DIG. 3

(58) Field of Classification Search ..... 2/2.5, 69, 2/455, 459, 461, 463, 464, 465, 467, 913, 2/DIG. 3; 36/29, 44, 28, 3 B, 3 R, 43, 71, 36/31, 35 B, 93, 153
See application file for complete search history.

(56) References Cited

U.S. PATENT DOCUMENTS

| | | | | |
|---|---|---|---|---|
| 4,914,836 | A | 4/1990 | Horovitz | |
| 5,235,703 | A * | 8/1993 | Maynard | 2/462 |
| 6,093,468 | A | 7/2000 | Toms et al. | |
| 6,418,832 | B1 | 7/2002 | Colvin | |
| 6,428,865 | B1 * | 8/2002 | Huang | 428/35.7 |
| 6,485,446 | B1 | 11/2002 | Brother et al. | |
| 6,796,865 | B2 * | 9/2004 | Raithel et al. | 441/106 |

* cited by examiner

*Primary Examiner* — Danny Worrell
*Assistant Examiner* — Khaled Annis
(74) *Attorney, Agent, or Firm* — Rankin, Hill & Clark LLP

(57) ABSTRACT

A device for dispersing and dampening impact forces that includes a first sheet structure and a second sheet structure that are joined together at a boundary zone. The boundary zone joins the first sheet structure and the second sheet structure together to define at least one gas-tight chamber having two sides. A gas is contained within the gas-tight chamber at a pressure within a predetermined range of acceptable pressures for dispersing impact forces translated against one side of the device such that a blunt force trauma producing impact force is not transferred through the device to a wearer's body disposed proximal to the other side of the device.

18 Claims, 6 Drawing Sheets

FIG. 6A
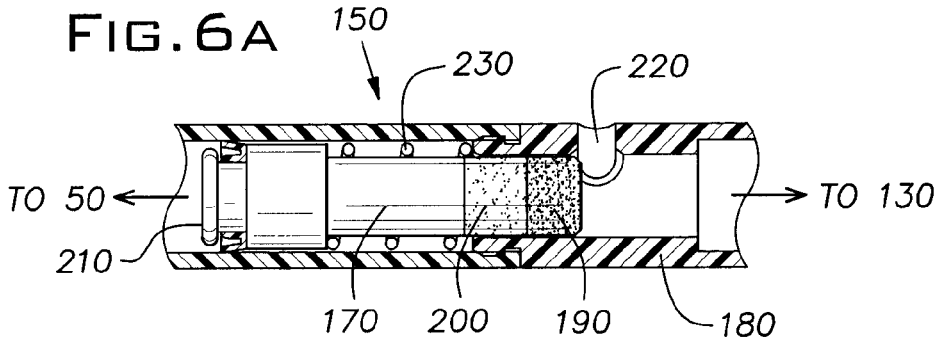
FIG. 6B
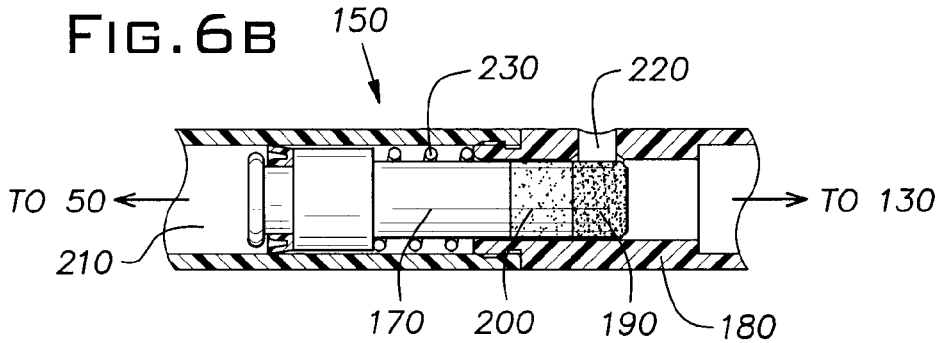
FIG. 6C
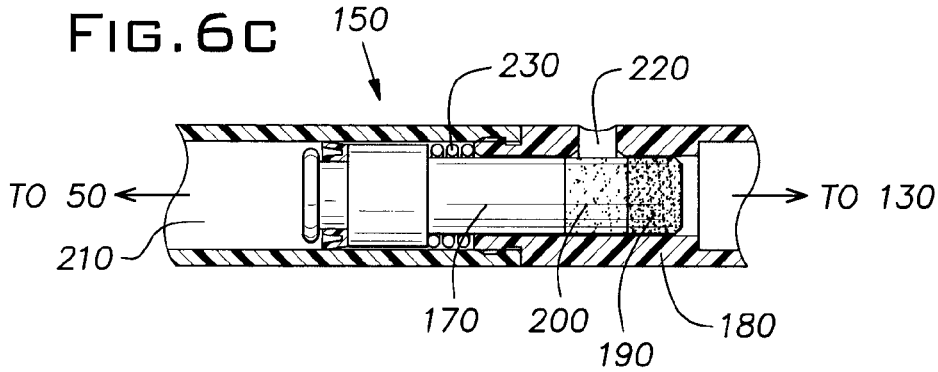
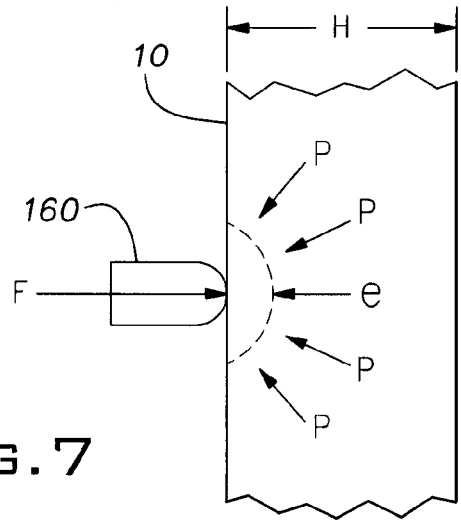
FIG. 7

DEVICE FOR DISPERSING AND DAMPENING IMPACT FORCES

BACKGROUND OF INVENTION

1. Field of Invention

The present invention relates to a method and a device for dispersing and dampening impact forces.

2. Description of Related Art

There are a many applications where it is highly desirable, if not absolutely vital, to effectively disperse and dampen impact forces directed toward a person or an object. One such application is in the field of body armor.

Body armor, which may include a ballistic vest (also known as a "bullet-proof" vest) alone or in combination with other protective clothing such as, for example, a helmet, ballistic shoulder armor and/or ballistic leg armor, is worn to protect a wearer's body from being pierced by gun-fired projectiles and explosive fragments. The most commonly used body armor is a ballistic vest, which protects the wearer's torso and thus the wearer's vital organs from penetration injuries.

In the past, ballistic vests were formed using steel plates and/or other rigid, heavy materials. Studies showed that heavy, uncomfortable body armor was less likely to be worn than lighter, more comfortable body armor. Thus, ballistic vest manufacturers developed lighter weight materials. Most modern ballistic vests are made from synthetic fabrics comprising ballistic fibers (e.g., KEVLAR®), which may be supplemented with ceramic plates and/or metal plates. This type of body armor is generally referred to as "soft body armor".

The impact of a projectile against a ballistic vest directs an impact force toward the torso of the wearer. Unless the impact force is adequately dispersed, the impact force can produce blunt force trauma injuries to the wearer of the ballistic vest, which can result in severe internal injuries or death. Thus, ballistic vest manufacturers must also devise ways in which to disperse the impact forces transferred through the ballistic vest toward the wearer's torso.

One way in which to gauge the impact force transferred through a ballistic vest to the torso of a person wearing the ballistic vest is to measure the amount of deformation the ballistic vest permits in a backing material when the ballistic vest is struck with a projectile under controlled conditions. Throughout the instant specification and in the appended claims, the term "deformation" means the maximum depth measurement of backface signature in the backing material caused by a fair hit that does not penetrate the ballistic vest when tested in accordance with the testing standards set forth in National Institute of Justice (NIJ) Standard 0101.04 Rev. A (June 2001), entitled: "The Ballistic Resistance of Personal Body Armor", which is hereby incorporated by reference in its entirety Section 4.6 of that standard provides in pertinent part that any designated depth measurement of backface signature in the backing material greater than 44 mm by any fair hit shall constitute a failure.

In order to meet the minimum requirements of NIJ Standards (Note: NIJ Standard 0101.04 has been superseded by more recent standards, but is nevertheless referenced for this specification), some ballistic vest manufacturers enclose one or more soft foam-like pads within the ballistic vest such that they are positioned proximal to the wearer's body when the ballistic vest is properly donned. The foam-like pads are intended to disperse the impact force over a larger area of the wearer's torso and thereby dampen the deformation and blunt force trauma directed to the wearer's torso. Other ballistic vest manufacturers employ inserts containing viscoelastic polymers, ceramic plates and/or various metallic mechanical structures for this purpose.

One of the drawbacks with the use of such prior art impact force dispersion and dampening devices is that they tend to be relatively bulky and heavy. This can be particularly problematic when the wearer of the ballistic vest is deployed in a high temperature environment such as a desert or inside an enclosed motor vehicle. Because the ballistic vest is often worn during an entire shift or period of deployment in close contact with the wearer's body, the vest can retain significant body heat, causing the wearer to perspire. Perspiration can weaken the strength and integrity of the ballistic fibers used to form the armor, and thereby diminish the penetration efficiency of the ballistic vest. Furthermore, the accumulation of perspiration in the vest creates additional weight and makes the vest uncomfortable. This can motivate a wearer to at least partially remove the ballistic vest, thereby exposing the wearer to harm.

In addition to ballistic vests, there are many other applications in which it would be highly desirable to be able to effectively disperse and dampen impact forces directed at a person or an object using a lightweight device that does not promote heat retention and perspiration. Such other applications include sporting goods (e.g., baseball catcher's equipment, football pads etc.), medical devices, automotive and aircraft interiors and the like.

BRIEF SUMMARY OF THE INVENTION

In view of the foregoing, the present invention is directed toward a device for dispersing and dampening impact forces. The device according to the invention comprises a first sheet structure and a second sheet structure that are joined together at a boundary zone. The boundary zone joins the first sheet structure and the second sheet structure together to define at least one gas-tight chamber, which is pre-filled with gas in order to absorb and disperse the impact energy. The pressure of the gas within the gas-tight chamber is maintained at a pressure within a predetermined range of acceptable pressures suitable for dispersing impact forces translated against one side of the device such that a blunt-force trauma inducing force is not transferred through the device to a wearer's body on the other side of the device.

In a preferred embodiment of the invention, a plurality of ventilation holes that are bounded by perimeter weld joints are disposed in a spaced-apart relationship across the area of the device defined by the boundary zone. Additional weld seams can present to maintain the thickness dimension of the device in a pressurized condition such that the thickness of device is relatively uniform and consistent across the sheet. The weld seams can also be utilized to create channels or valleys along an inner side of the device, which can be used to transport heat and moisture away from a wearer's body.

The device according to the invention is particularly suitable for use in dispersing impact forces transferred through ballistic vests. The device is relatively thin, lightweight and breathable, yet is able to absorb and disperse substantial impact forces and thereby protect the wearer from blunt force trauma. The device according to the invention can also be used in other applications include sporting goods (e.g., baseball catcher's equipment, football pads etc.), medical devices, automotive and aircraft interiors and the like.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein:

FIGS. 6A through 6C show various cross-sectional views of an exemplary pressure indicator for use in the invention;

FIG. 7 is a schematic illustration that shows an impact force being transferred to a device according to the invention;

It should be noted that the drawings are intended to depict only exemplary embodiments of the invention and therefore should not be considered as limiting the scope thereof. It is further noted that the drawings may not be necessarily to scale. The invention will now be described in greater detail with reference to the accompanying drawings.

DETAILED DESCRIPTION OF THE INVENTION

Figure 1:
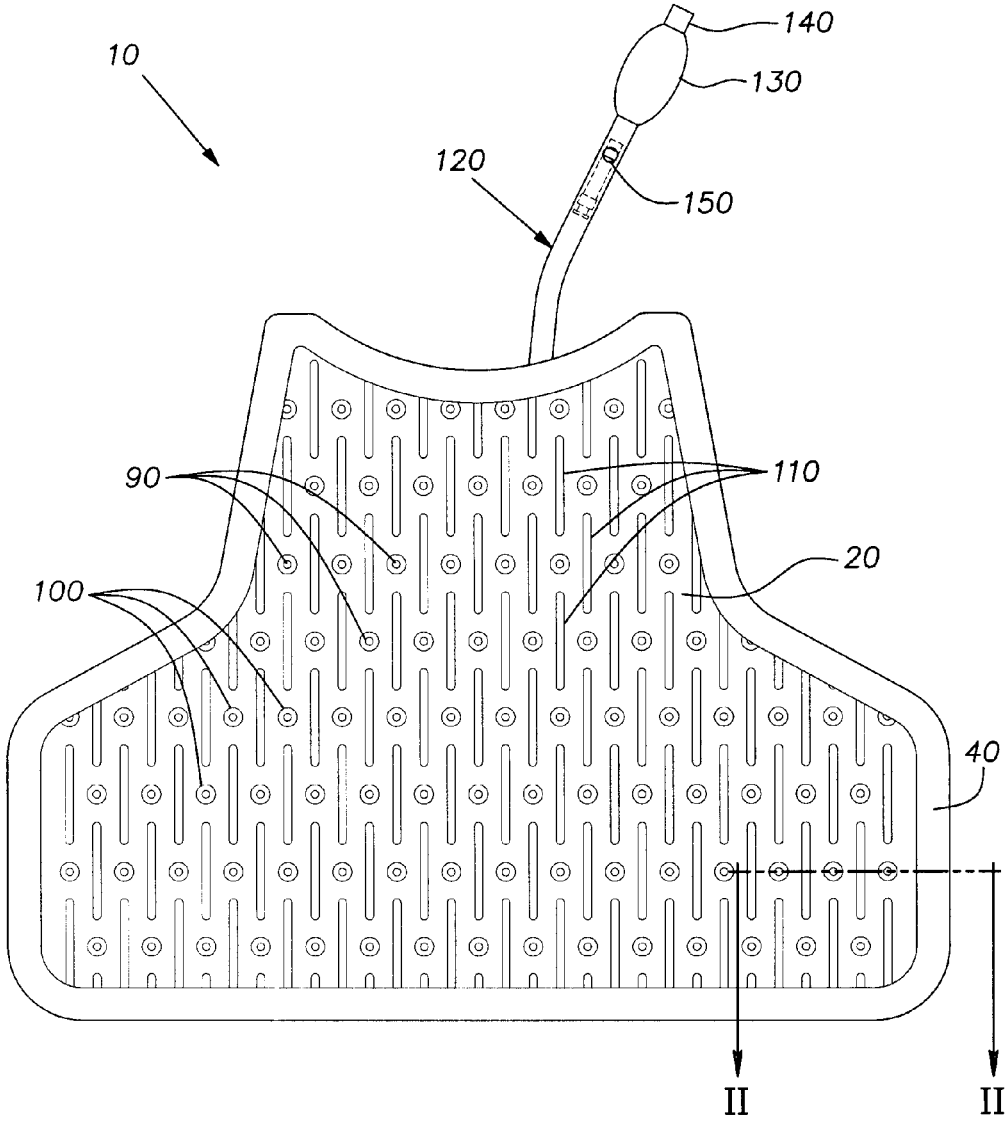
FIG. 1 is a front plan view of an exemplary device in accordance with one embodiment of the invention.

An exemplary device 10 for dispersing and dampening impact forces according to the invention is schematically illustrated in FIG. 1. In the embodiment illustrated in FIG. 1, the device 10 is sized and shaped such that it is suitable for use in dispersing and dampening impact forces directed through a ballistic vest toward the torso of a wearer of the ballistic vest. The device 10 could be enclosed within the inner fabric of the ballistic vest such that in use the device 10 is disposed proximal to the wearer's torso (i.e., between the anti-penetration material of the ballistic vest and the wearer's torso). Alternatively, the device 10 could be removably retained to an inner side of the ballistic vest (e.g., through the use of hook and loop fasteners, straps and/or snap fasteners etc.) such that in use the device 10 is disposed proximal to the wearer's torso. Or, the device 10 could be entirely separate and discrete from the ballistic vest and could be retained proximal to the wearer's torso between the ballistic vest and the wearer's torso (e.g., by associating the device 10 with another article of clothing worn by the wearer).

Figure 2:
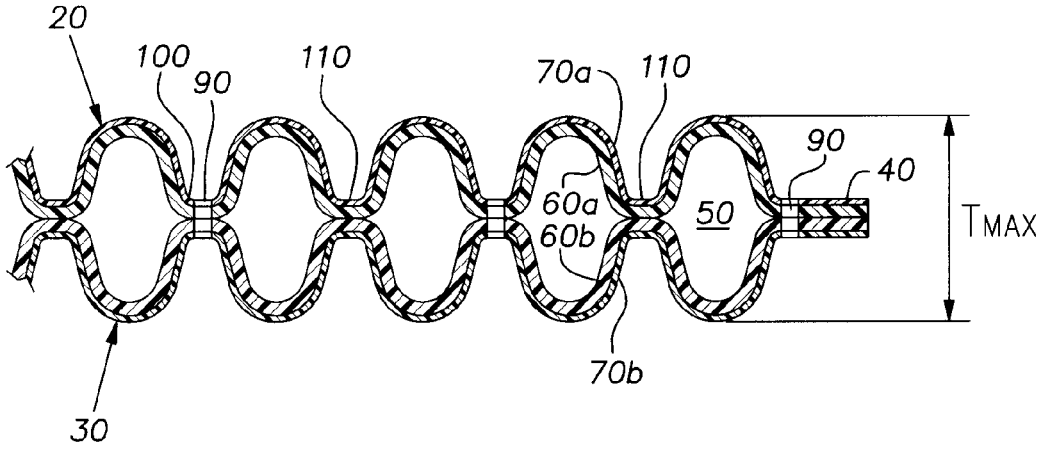
FIG. 2 is an enlarged cross-section view of a portion of the device shown in FIG. 1 taken along the lines II-II in FIG. 1.

FIG. 2 shows a cross section view of the device 10 shown in FIG. 1 taken along the line II-II. As shown therein, the device 10 according to the invention comprises at least a first sheet structure 20 and at least a second sheet structure 30 that are joined together at a boundary zone 40. The boundary zone 40 joins the first sheet structure 20 and the second sheet structure 30 together to define a substantially gas-tight chamber 50. The term "substantially" is used herein inasmuch as it is likely that some gas retained within the gas-tight chamber 50 may slowly permeate through the material from which the device 10 is constructed or otherwise leak out of the device 10 over time. In accordance with the invention, the chamber 50 is considered "substantially" gas-tight when it does not allow for the rapid escape of a gas retained therein and thus permits a gas to be contained within the gas-tight chamber 50 at a pressure above atmospheric pressure for at least 1 hour. The gas retained within the gas-tight chamber 50 can be air, nitrogen, argon, helium or other generally non-corrosive and/or inert gases. In view of cost and performance, air and/or nitrogen are presently preferred.

The width of the boundary zone 40 is selected in view of the pressures to be retained within the gas-tight chamber 50 and the environment within which the device 10 is to be used. The boundary zone must be sufficiently wide to prevent rupture of the gas-tight chamber 50 when impact forces are applied to the device 10, and also to prevent rupture when the device 10 is used in its intended application. When the device 10 is adapted for use in dispersing impact forces transferred through a ballistic vest toward the torso of a wearer, a boundary zone 40 having a width of at least about ⅜" (~9 mm) is generally considered to be adequate.

The first sheet structure 20 preferably comprises a composite material that comprises at least a thermoplastic inner layer 60*a* and a fibrous layer 70*a*, which could be woven or unwoven. The fibrous layer 70*a* could be an outer layer or an intermediate layer. The second sheet structure 30 also preferably comprises a composite material that comprises at least a thermoplastic inner layer 60*b* and a fibrous layer 70*b*, which could be woven or unwoven. The fibrous layer 70*b* could be an outer layer or an intermediate layer. The fibrous layers 70*a*, 70*b* preferably provide abrasion resistance and also limit the extent to which the device 10 can expand when inflated.

The first sheet structure 20 and the second sheet structure 30 can be formed of the same composite material or from different composite materials, if desired. Additional layers can be present in the composite materials used to form the first and second sheet structures 20, 30.

It will be appreciated that the first sheet structure 20 and the second sheet structure 30 can each be separate pieces of a composite material that are joined together. Alternatively, a single sheet of composite material can be folded onto itself to form a first sheet structure 20 and a second sheet structure 30, which are then joined together at a boundary zone 40.

In a preferred embodiment of the invention, the first sheet structure 20 and the second sheet structure 30 are each formed of a thermoplastic polyurethane coated woven nylon fabric such as is commercially available from Brookwood Laminating of Wauregan, Conn. The thermoplastic polyurethane coating allows for the formation of a gas-tight chamber 50 via conventional polymer welding techniques, whereas the woven nylon fabric provides abrasion resistance and also limits the degree to which the device 10 can expand when inflated. In such fabrics, the thermoplastic polyurethane coating constitutes the inner layer 60*a*, 60*b* and the woven nylon fabric constitutes the outer layer 70*a*, 70*b*. A 300-400 denier woven nylon fabric with about a 0.003" to about a 0.004" (~0.08-0.1 mm) thick urethane coating is presently most preferred when the device 10 is intended for use in ballistic vest applications. Heavier fabrics (e.g., up to about 600 denier) with thicker thermoplastic polyurethane coatings can also be used, if desired, but such materials offer less flexibility and more weight and are thus less comfortable in ballistic vest applications.

Figure 3:
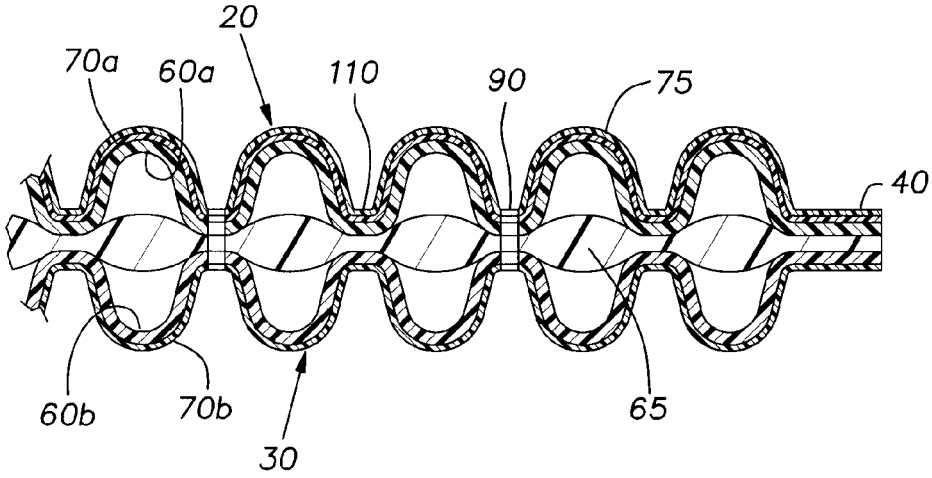
FIG. 3 is an enlarged cross-section view of a portion of another embodiment of a device in accordance with the invention.

As noted above, the first sheet structure and the second sheet structure 20, 30 can optionally further optionally comprise additional layers or features. FIG. 3 shows a cross-section view of a portion of another embodiment of a device 10 according to the invention in which a temperature-retaining gel pad 65 is retained between the first sheet structure 20 and the second sheet structure 30 within the gas-tight chamber 50. A device 10 having a structure such as depicted in FIG. 3 can be stored in a refrigerator or freezer until the time of use, whereupon the chilled gel pad 65 can provide cooling comfort to the wearer of the device 10. Preferably, a non-toxic water-based gel is used. A gel pad 65 is a passive cooling device. It will be appreciated that active cooling devices such as, for example, heat transfer systems that include one or more tubes through which a cooling fluid is circulated could also be installed within the gas-tight chamber 50 and/or in the first or second sheet structures 20, 30.

With further reference to FIG. 3, an electrically conductive coating or foil layer 75 can be applied to an exterior side of a device 10 according to the invention. The electrically conductive coating or foil layer 75 can comprise an integral layer of the composite material from which the first sheet structure 20 is formed (e.g., via lamination). Alternatively, the electrically conductive coating or foil layer 75 can be separate and distinct from the composite material from which the first sheet structure 20 is formed. An electrically conductive coating or foil layer 75 can be present to short out electrical discharges from devices such as TASER® weapons and thereby protect the wearer from being incapacitated thereby. Furthermore, the composite material can optionally comprise one or more anti-microbial coatings or materials, which aid in preventing and/or diminishing the presence of unpleasant odors.

It will be appreciated that the device 10 according to the invention can have an arcuate shape in cross-section, making it particularly well-suited for use in protecting shoulders and thighs from impact forces. In such applications, the device 10 can be installed between protective athletic equipment (e.g., football shoulder pads, shin and/or thigh pads, hockey equipment and baseball catcher's equipment) and the wearer's body.

As noted above, the thermoplastic inner layer 60*a* of the first sheet structure 20 can be joined to the thermoplastic inner layer 60*b* of the second sheet structure 30 to form the boundary zone 40 using a variety of conventional polymer bonding techniques. Radio Frequency ("RF") welding, which is well known, is preferably used to permanently bond the inner layer 60*a* of the first sheet structure 20 to the inner layer 60*b* of the second sheet structure 30. Other conventional welding and bonding processes can also be used, if desired.

Preferably, a plurality of spaced apart ventilation holes 90 are provided completely through the device 10 within the area defined by the boundary zone 40. The ventilation holes 90 allow heat and/or water vapor from perspiration to escape from the wearer's body, which improves comfort. In order to preserve the substantially gas-tight nature of the chamber 50, the inner side 60*a* of the first sheet structure 20 must be joined to the inner side 60*b* of the second sheet structure 30 around the entire perimeter 100 of each of the plurality of ventilation holes. As in the case of the boundary zone 40, the inner side 60*a* of the first sheet structure 20 can be joined to the inner side 60*b* of the second sheet structure 30 around the entire perimeter 100 of the ventilation holes 90 using an RF welding technique or other bonding technique.

Preferably, the plurality of ventilation holes 90 are distributed substantially uniformly within the area bounded by the boundary zone 40. The ventilation holes 90 are preferably spaced apart from each other a distance of from about 0.375" to about 2.0" (~9-51 mm). In the embodiment of the invention illustrated in FIG. 1, the ventilation holes 90 are aligned in a series of horizontal lines across the device 10, with each ventilation hole 90 in the horizontal line being spaced about 1" (~25 mm) apart from the next ventilation hole 90 in the horizontal line. The horizontal lines are offset such that the ventilation holes 90 are spaced apart about 1⅞" (~47.5 mm) from the nearest two ventilation holes 90 in the next adjacent horizontal line. It will be appreciated that other ventilation hole 90 arrangements can be used, if desired.

The ventilation holes 90 preferably define an opening or via having a diameter of from about 0.125" to about 0.25" (~3-6.5 mm), and are bounded by a perimeter 100 having a width of from about 3/32" to about 3/16" (~2-5 mm). In the embodiment illustrated in FIG. 1, the diameter of each opening or via of each ventilation hole 90 is about 0.15" (~4 mm), and each ventilation hole 90 is surrounded by a perimeter 100 having a width of about 0.11" (~3 mm).

It will be appreciated that the spaced-apart joints between the inner side 60*a* of the first sheet structure 20 and the inner side 60*b* of the second sheet structure 30 around the entire perimeter 100 of the plurality of ventilation holes 90 also serve to limit the distance the first sheet structure 20 can separate from the second sheet structure 30 when the gas-tight chamber 50 is inflated with a gas to a pressure within the predetermined range of acceptable pressures. The relatively uniform distribution of ventilation holes 90 across the entire area bounded by the boundary zone 40 also helps maintain a relatively uniform thickness dimension when the device 10 is inflated with a gas to a pressure within the predetermined range of acceptable pressures.

Optionally, a plurality of spaced apart, discontinuous weld seams 110 can also formed to join the inner layer 60*a* of the first sheet structure 20 to the inner layer 60*b* of the second sheet structure 30 at various locations within the area defined by the boundary zone 40. The shape and arrangement of the weld seams 110 is not per se critical, and a variety of shapes and arrangements can be used provided they do not unduly restrict the flow of air through the gas-tight chamber 50 and are sufficient to keep the first sheet structure 20 and the second sheet structure 30 bonded together as desired. It will also be appreciated that no weld seams 110 need be present in the device 10 (see, e.g. FIG. 5) provided there are sufficient ventilation holes 90 provided within the area defined by the boundary zone 40.

In the embodiment of the invention illustrated in FIG. 1, the weld seams 110 are about 2⅛" long and about 3/16" in width (~54 mm×4.5 mm). The weld seams 110 are arranged in the spaces between the plurality of ventilation holes 90 to create a pattern in which the maximum a gap between adjacent joints between the first sheet structure 20 and the second sheet structure 30 (i.e., ventilation holes 90 and/or weld seams 110) is from about 0.4" to about 0.5" (~10-13 mm). This spacing ensures that the device 10 has a relatively uniform maximum thickness dimension, and that there are many fluidly-connected air pockets when the device 10 is inflated such that only about 30% of the surface area of the device 10 is available to contact the wearer's torso. Furthermore, the arrangement of the weld seams 110 in a substantially vertical aligned arrangement tends to create vertical troughs or valleys through which moisture and heat can escape from the device 10.

The perimeter 100 of the ventilation holes 90 and the spaced apart, discontinuous weld seams 110 are preferably formed using a thermal calendaring process. The joints formed between the inner layer 60*a* of the first sheet structure and the inner layer 60*b* of the second sheet structure 30 prevent the first sheet structure 20 and the second sheet structure 30 from separating from each other in excess of a predetermined maximum thickness, which is defined as the greatest distance from the outer layer 70*a* of the first sheet structure 20 to the outer layer 70*b* of the second sheet structure 30 when the gas-tight chamber 50 is inflated to the maximum pressure within the predetermined range of acceptable pressures. The predetermined maximum thickness of a particular device 10 will be determined based on the particular application in which the device 10 is to be employed. When the device 10 is configured for use in dispersing and dampening impact forces transferred through a ballistic vest, the predetermined maximum thickness of the device 10 is preferably from about 0.25" to about 0.5" (~6-13 mm).

In many embodiments, it is preferable for the device 10 to have a predetermined average thickness that is about the same as the predetermined maximum thickness of the device 10. The predetermined average thickness can be determined by averaging the maximum distance from the outer layer 70*a* of the first sheet structure 20 to the outer layer 70*b* of the second sheet structure 30 at every location between adjacent ventilation holes 90 and weld seams 110 (where present) when the gas-tight chamber 50 is inflated to the maximum pressure within the predetermined range of acceptable pressures. In the preferred embodiment, the predetermined average thickness of the device 10 is about the same as the predetermined maximum thickness of the device 10 and the device 10 has a generally uniform thickness across the entire area within the boundary zone 40. However, it will be appreciated that in other embodiments it may be desirable for the device 10 be less thick in some locations (e.g., under the wearer's armpits) and thicker in other locations (e.g., over the wearer's heart and other vital organs) than the predetermined average thickness.

Figure 4:
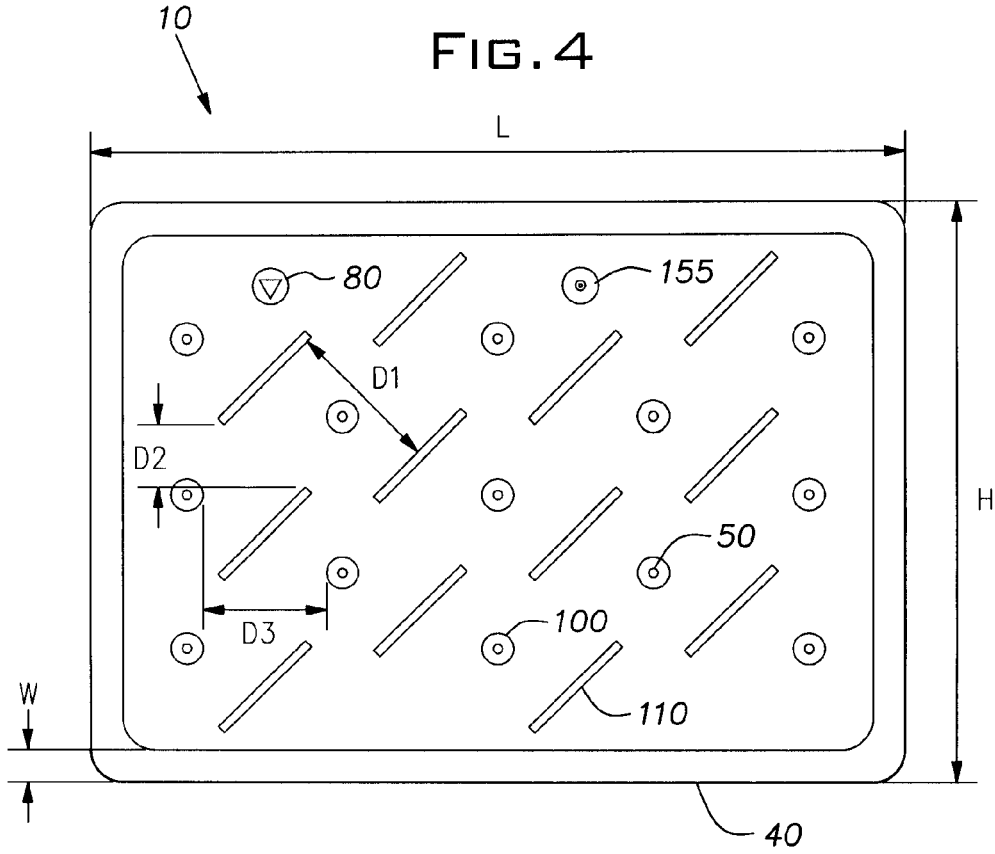
FIG. 4 is a front plan view of another embodiment of a device according to the invention.

FIG. 4 shows an alternative embodiment of a device 10 according to the invention. In such embodiment, the device 10 is rectangular in shape, having a length L and a height H that can be of any desired dimension. It will be appreciated that the shape of the device 10 is not limited to rectangles, and that any desired shape can be used. The width W of the boundary zone 40 can also be of any desired dimension. The spacing D1, D2 between adjacent weld seams 110 and the spacing D3 between ventilation holes 90 can also be any desired dimension. The predetermined maximum thickness and average thickness of the device 10 can also be of any desired dimension.

In the embodiment illustrated in FIG. 4, an external pump (not shown) must be used to inflate the gas-tight chamber 50 to a pressure within the predetermined range of acceptable pressures. A gas is pumped into the device 10 through an inflation port 155. A pressure regulating valve 80 can be installed in fluid communication with the gas-tight chamber 50 to insure that the pressure of the gas pumped into the gas-tight chamber 50 is maintained within a predetermined range of acceptable pressures. The pressure regulating valve 80 allows excess gas pumped into the gas-tight chamber 50 to be expelled, thereby prohibiting the pressure within the gas-tight chamber 50 from exceeding the maximum permissible pressure within the range of predetermined acceptable pressures.

Figure 5:
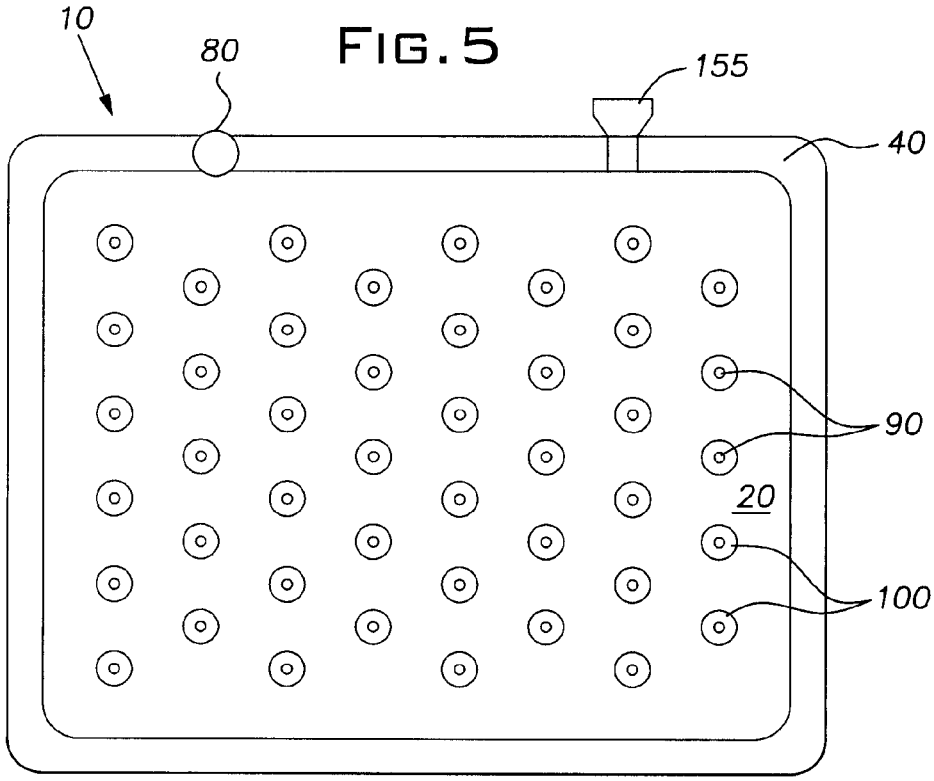
FIG. 5 is front plan view of yet another embodiment of the invention.

FIG. 5 shows yet another alternative embodiment of a device 10 according to the invention. In this embodiment, the pressure regulating valve 80 is shown as being captured between the first sheet structure 20 and the second sheet structure 30 in the boundary zone 40. In this position, the pressure regulating valve can be secured using an RF welding process. It will be appreciated, however, that a pressure regulating valve 80 could be disposed entirely within either the first sheet structure 20 as illustrated in FIG. 4, or the second sheet structure 30, if desired. Similarly, the inflation port 155 can also be disposed entirely within either the first sheet structure 20 as illustrated in FIG. 4, or the second sheet structure 30. Alternatively, the inflation port 155 can be captured between the first sheet structure 20 and the second sheet structure 30 in the boundary zone 40 as illustrated in FIG. 5.

As noted, the pressure regulating valve 80 prevents the gas pressure within the gas-tight chamber 50 from exceeding the maximum permissible pressure within the predetermined range of acceptable pressures. This can be advantageous when the device 10 is used in static environments, such as in aircraft bulkheads, or is being used to protect objects in transit from unexpected impacts. However, the use of a pressure regulating valve 80 is generally not desirable in applications where the device 10 is used in dynamic conditions, where pressures other than impact pressures are applied to the device 10 (e.g., a human being applying his or her body weight to the device 10). Suitable pressure regulating valves 80 for use in the invention are available from Halkey-Roberts Corporation of St. Petersburg, Fla.

In the embodiment illustrated in FIG. 1, the device 10 further comprises an integral pump 120 that include a bulb portion 130 and a valve 140. Similar integral pumps 120 having bulb portions 130 and valves 140 are often used in the manufacture of blood pressure cuffs. The wearer can squeeze the bulb portion 130 by hand to pump air into the gas-tight chamber 50.

In one embodiment, the valve 140 can be selectively opened or closed by the wearer to pressurize and depressurize the gas-tight chamber 50. More preferably, however, the wearer does not have the ability to selectively depressurize the gas-tight chamber 50 via the valve 140, which can avoid compliance problems.

While it may be possible to permanently seal the gas-tight chamber 50 to enclose a defined volume of gas at a defined pressure within the predetermined range of acceptable pressures, it is generally not preferred. In the case of ballistic vest applications, where the volume of gas retained in the gas-tight chamber 50 and the surface area of the device 10 tends to be relatively large, it is expected that some gas will permeate through the composite material and the gas-tight chamber 50 over time. This can be diminished to some degree by disposing a sealing liquid such as HI-FLOAT®, which is available from HI-FLOAT Company of Louisville, Ky., into the fluid-tight chamber 50. But a completely gas-tight chamber 50 cannot practically be maintained in a permanent gas-tight condition for the entire service life of the device 10. It is thus preferably for such devices 10 to be equipped with a port 155 through which a gas can be pumped and/or an integral pump 120, such as shown in FIG. 1.

In the embodiment of the device 10 illustrated in FIG. 1, a pressure gauge 150 is shown as being installed within the tubing of the integral pump 120. The pressure gauge 150 allows the wearer to confirm that the gas-tight chamber 50 of the device 10 is properly inflated to a pressure within the predetermined range of acceptable pressures. The pressure gauge 150 can be a simple pneumatic gauge. Alternatively, the pressure gauge 150 can be an electronic device that transmits a signal to the wearer or an electronic device carried by the wearer. The electronic device can monitor the pressure in the gas-tight chamber 50 and provide a warning to the wearer if the pressure within the gas-tight chamber 50 drops below the predetermined range of acceptable pressures. It will be appreciated that the pressure gauge 150 can be attached to the device 10 separate from the integral pump 120.

FIGS. 6A-6C show sectional views of a preferred pressure gauge 150 for use with a device 10 according to the invention. FIG. 6A shows a plunger 170 disposed within the tubing 180 between the bulb portion 130 and the gas-tight chamber 50. The plunger 170 has a first portion 190 having a first color (e.g., red) and a second portion 200 having a second color (e.g., green). As shown in FIGS. 6B and 6C, gas pressure on a rear portion 210 of the plunger 170 pushes the first portion 190 of the plunger 170 toward a view window 220. Movement of the plunger 170 in that direction is resisted by a spring 230. When the pressure of the gas on the rear portion 210 of the plunger 170 is below the predetermined range of acceptable pressures, only the first portion 190 of the plunger 170 is visible through the view window 220, as shown in FIG. 6B. But, when the pressure of the gas on the rear portion 210 of the plunger 170 is within the predetermined range of acceptable pressures, only the second portion 200 of the plunger 170 is visible through the view window 220, as shown in FIG. 6C. It will be appreciated that the plunger 170 can be provided with additional color-coded bands, if desired, which can indicate whether the pressure in the gas tight chamber 50 exceeds the predetermined range of acceptable pressures. But this is generally not required inasmuch as the valve 140 on the integral pump 120 can be configured to limit the maximum pressure.

Generally speaking, when the device 10 is used to disperse and dampen impact forces directed through a ballistic vest toward the torso of a wearer of the ballistic vest, the preferred predetermined range of acceptable pressures is typically from about 1.5 to about 6 pounds per square inch ("psi") (~0.1-0.5 bar), or more preferably from about 3 to about 4 psi (~0.2-0.3 bar). The predetermined range of acceptable pressures can be determined with reference to several equations and to FIG. 7, which depicts the impact force from a hypothetical bullet 160 being transferred through a ballistic vest into contact with one side of a device 10 according to the invention.

When the gas tight chamber 50 within the boundary zone 40 of the device 10 is substantially flat, the volume "V" of the device 10 can be fairly approximated using Formula (I):

$$V=(S-S_1)\times H \tag{I}$$

where "S" represents the area of the device 10 within the boundary zone 40, "$S_1$" represents the sum of the area of the ventilation holes 90 and "H" represents the average thickness of the device (also referred to herein as $T_{AVG}$).

The impact force produced by a bullet 160 can be approximated using the formula F=ma, where "m" is the mass of the bullet 160 and "a" is the acceleration of the bullet 160. Similarly, the dynamic change in gas pressure within the device 10 can be approximated using the formula $P=P_0+\Delta P$, where "$P_0$" represents the initial pressure in the device 10 before the impact force is applied and "ΔP" represents the dynamic pressure change that occurs as the gas within the device 10 absorbs the impact energy. Because at any moment in time during the impact event, the pressure ("P") must be equal to the impact force ("F") applied to the device 10, the following formula can be used $ma=P_0+\Delta P$.

The condition of the gas inside the device 10 at all times is reflected in Formula (II):

$$\frac{P_0V_0}{T_0}=\frac{P_1V_1}{T_1} \tag{II}$$

where "$P_x$" represents pressure at time x and "$V_x$" represents volume at time x, and "$T_x$" represents temperature at time x, and where x is 0 immediately before impact of the bullet 160 and 1 when the maximum impact force is being translated to the device 10 by the bullet 160. When one considers the small differential in temperature that occurs from x=0 to x=1, the $T_x$ values can be removed from the equation leaving only $P_0V_0=P_1V_1$.

With reference to FIG. 7, the parameter "e" represents the deformation of the impact side of the device 10 that occurs as a result of the impact of the bullet 160 against the ballistic vest. To simplify calculations, one can approximate the volume of "e" as $e^3$ (i.e., e times e times e). The change in dynamic pressure relative to the decrease in volume can be approximated by the formula $P_0V_0=(P_0+\Delta P)(V_0-e^3)$. Solving for ΔP, one arrives at Formula (III):

$$\Delta P \cong \frac{P_0e^3}{V_0e^3} \tag{III}$$

In view of the area of the bullet 160 compared to the area of the device 10, $e^3$ must be substantially less than $V_0$. Thus, Formula (III) can be further reduced as shown in Formula (IV):

$$\Delta P \cong \frac{P_0}{V_0}e^3 \tag{IV}$$

In order to prevent deformation of the side of the device 10 proximal to the body of the person or object being protected, H represents the maximum value for "e". Thus, the equation can be further reduced as shown in Formula (V):

$$\Delta P \approx \frac{P_0H^3}{S\times H}=\frac{P_0}{S}H^2 \tag{V}$$

One can thus solve the equation of $P_0$ to determine the optimal initial pressure of the gas within the device 10 required to prevent an impact force applied to an impact side of the device 10 from deforming the rear side of the device 10 during impact. The optimal initial pressure $P_0$ is thus selected within a range that maximizes the impact force dispersion for the particular application, in view of the area and thickness of the device 10.

When a sudden impact force is applied to the device 10, the gas molecules within the gas-tight chamber 50 in the immediate area where the impact force was applied to the device 10 are compressed, but because gas molecules are able to move very quickly within and disperse throughout the entire volume of the gas-tight chamber 50, the gas molecules quickly move and then equilibrate the pressure within the gas-tight chamber 50. For this reason, the device 10 is surprisingly better at dispersing impact forces from relatively lightweight fast-moving objects, such as bullets, athletic balls and other projectiles, as compared to impact forces from heavy, slow moving objects.

In a preferred manufacturing process, the material used to form the first and second sheet structures 20, 30 is cut to size, preferably numerous sheets at a time. The thermoplastic polyurethane coated sides of the material are positioned to face each other. Holes are provided through the sheet structures to insure proper alignment. The sheets are then joined using an RF sealing tool.

A 75 kw dielectric fabric welder can be used to dielectrically weld the urethane coated sheet structures together to form the perimeter 100 of the ventilation holes 90 and the weld seams 110. The power level and time can be adjusted, as necessary, depending on the thickness of the fabric. Quality control testing can be used to determine the appropriate settings necessary to achieve a satisfactory seal. The same fabric welder can be used to dielectrically weld the boundary zone 40. Valve sealing is typically completed using a 25 kw dielectric fabric welding machine.

The device for dispersing and dampening impact forces according to the invention provides many benefits over prior art devices. It provides greater impact force dispersion and dampening at a lower average thickness as compared to prior art devices. This makes the device according to the invention particularly well suited for use in ballistic vest applications. Because the impact force is transferred to a gas retained in a large volume gas-tight chamber, the impact force can be rapidly dispersed over a wide area, which dampens the force transmitted to the wearer. This effectively reduces the risk of blunt force trauma to the wearer, which can cause cardiac arrest, loss of consciousness, bone fractures, muscle bruises, and/or internal organ damage.

The device according to the invention is lighter weight than prior art devices. And, the device according to the invention includes substantial ventilation for the wearer, making the device particularly we suited for use in high temperature environments. Furthermore, the device according to the invention retains some flexibility, which improves the wearer's comfort and does not restrict the wearer's mobility. This makes the device according to the invention suitable for use in sporting goods (e.g., baseball catcher's equipment, football pads etc.), where restrictions on mobility are counter-productive.

The device according to the invention can be repaired, if punctured, using conventional air-bladder repair means. When inflated, it improves buoyancy and can help prevent drowning.

In some embodiments, the device according to the invention can also be selectively deflated without being removed by the wearer. For example, a soldier wearing the device can deflate the device when in a safe area (e.g., within an armored vehicle), but can rapidly inflate the device when the soldier is preparing to exit the safe area. This allows the soldier to be comfortable, yet safe.

In a preferred method of the invention, a user positions the device according to the invention between a body part such as his or her torso and a piece of protective equipment such as a ballistic vest. In one embodiment, the device according to the invention is permanently secured to a side of the protective equipment that is proximal to the user's body. In another embodiment, the device according to the invention is removably secured to the protective equipment (e.g., by fastening the device to the protective equipment using fasteners or by placing it into a pocket or pouch formed on a side of the protective equipment that is proximal to the user's body). In yet another embodiment, the device according to the invention is not fastened in any way to the protective equipment, but is simply retained in contact with the user's body and thus comprises an article of clothing being worn by the user.

Figure 8:
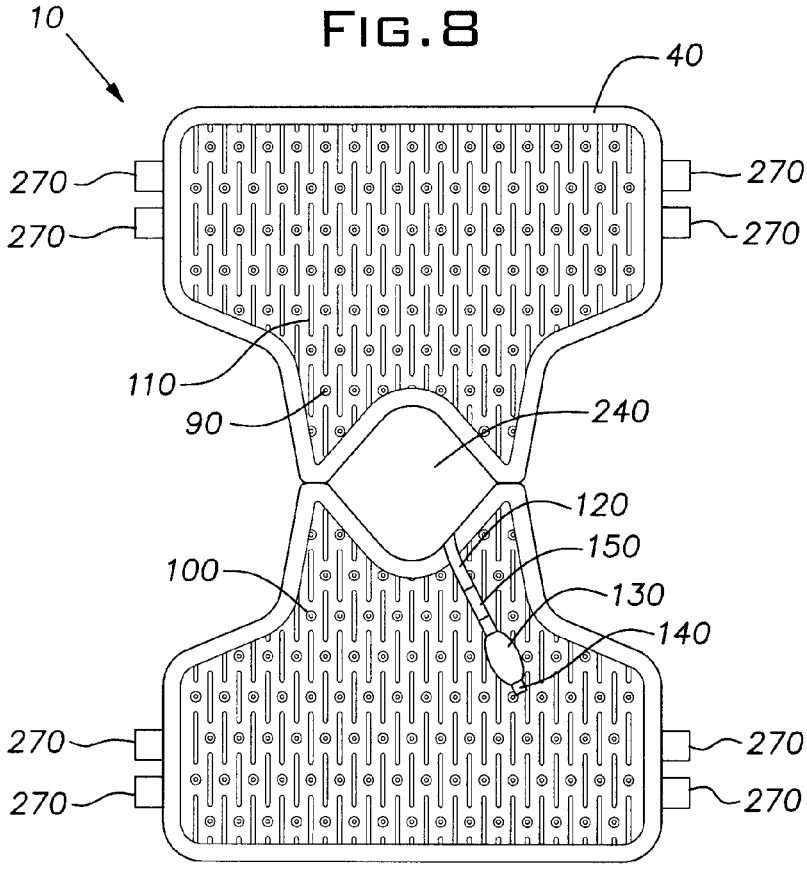
FIG. 8 is a top plan view of yet another embodiment of the invention.
Figure 9:
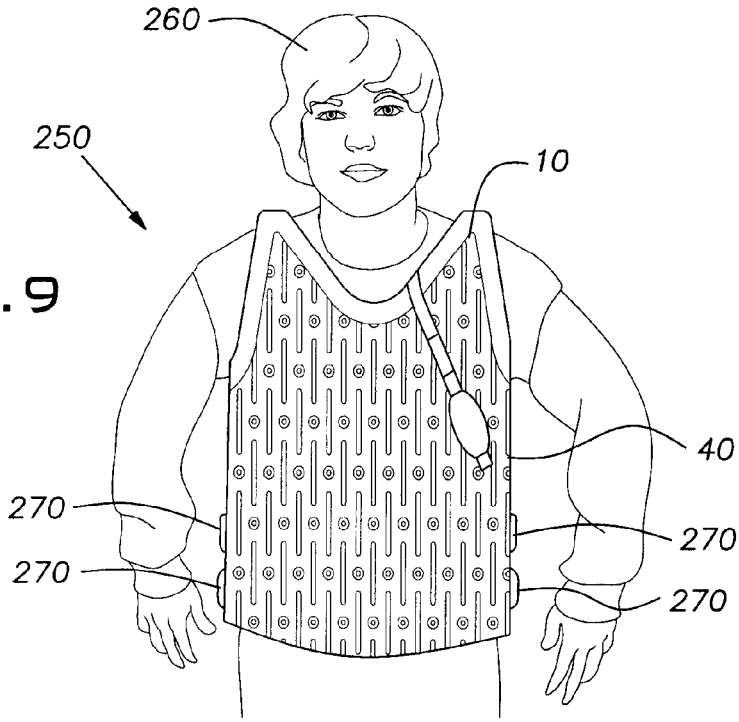
FIG. 9 is a schematic representation of the device shown in FIG. 8 being worn by a human being.
Figure 10:
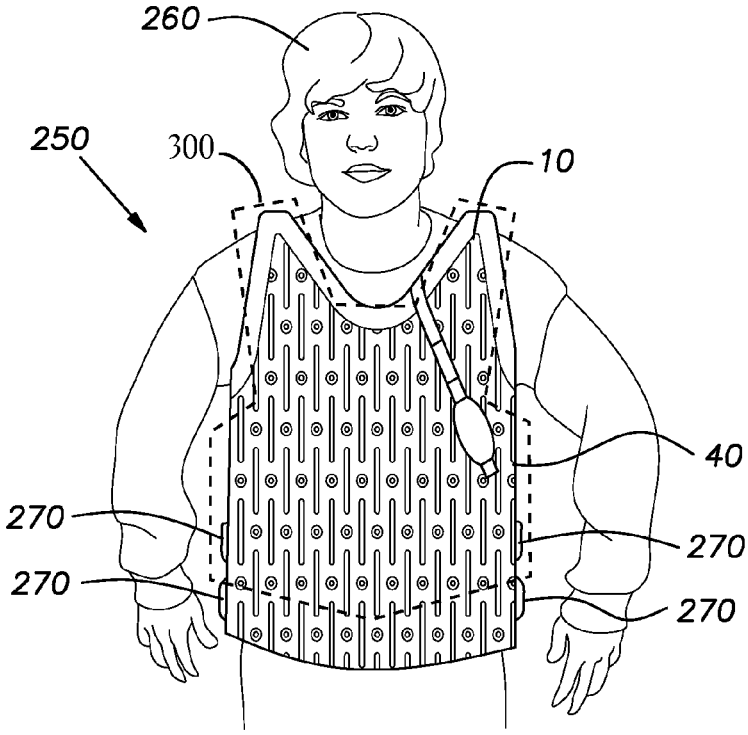
FIG. 10 is a schematic representation of the device shown in FIG. 8 positioned between a ballistic vest and a torso portion of a human being.

FIGS. 8, 9 and 10 schematically illustrate an alternative configuration of a device 10 according to the invention. In this embodiment, the device 10 includes an opening 240 within the area defined by the boundary zone 40 through which a human being 250 can insert his or her head 260. The device 10 is then draped over the shoulders to cover the torso portion of the human being 250 and is then fastened around the torso portion of the human being using suitable means, such as VELCRO® fasteners 270. A ballistic vest 300 (the outer perimeter of which is schematically depicted using dashed lines in FIG. 10) can then be donned by the human being 250 such that it overlays the device 10, thus disposing and positioning the device 10 between the armor portion of the ballistic vest 300 and the torso portion of the human being 250 (the ballistic vest 300 is depicted in FIG. 10 using dashed lines so as not to obscure the device 10 beneath the ballistic vest 300). The device 10 can be inflated to a pressure within the predetermined range of acceptable pressures using a pump 120 (which may but need not be integral) either before or after the ballistic vest is donned. A separate gas-tight chamber 50 can be provided on each of the front side and the rear side of the wearer's torso. More preferably, a single gas-tight chamber 50 is formed, meaning that the gas in the portion of the device adjacent to the rear side of the wearer's torso is also in fluid communication with the gas in the portion of the device adjacent to the front side of the wearer's torso. This maximizes the volume of the gas-tight chamber 50, and thus increases the impact absorbance capacity of the device 10.

The following examples are intended only to illustrate the invention and should not be construed as imposing limitations upon the claims.

EXAMPLE 1

Two pieces of 200 denier urethane coated nylon procured from Brookwood Laminating of Wauregan, Conn. were cut on the perimeter to a standard size of 18.5"×24" (~47 cm×61 cm). Holes were cut through the two layers of fabric, which was placed on a 75 kw Dielectric Fabric Welder with the urethane coated sides of the fabric in contact with each other. The 75 kw welder was pressed down onto the pieces of fabric to form weld seams and the perimeters of the holes to form a device as shown in FIG. 1.

A SLV-330 valve obtained from Martin-Weston Co. of Largo, Fla. was sealed between the two urethane coated nylon fabric pieces using a 25 kw electric welder. The 75 kw welder was used to form a continuous boundary zone measuring approximately ⅜" (~9 mm).

EXAMPLE 2

The device manufactured as described in Example 1 was tested for impact force dispersion and dampening efficiency using the test method set forth in NIJ 0101.04. A conventional XT-2 Type II ballistic vest obtained from American Body Armor of Jacksonville, Fla., USA was used. Table 1 below provides the results of the testing. For the "Example 1" data, the device according to the invention as manufactured in Example 1 was placed between the conventional XT2-2 ballistic vest and the backing material. For the "Control" data, the conventional XT2-2 ballistic vest alone.

TABLE 1

| Impact Force Dispersing and Dampening Device | Test Variables | | | Performance Maximum Depth of Deformation in Backing Material |
|---|---|---|---|---|
| | Test Round | Caliber of Test Ammunition | Hits at 0° Angle of Incidence | |
| Control | 1 | .38 | 1 | 17.8 mm |
| | 2 | .357 | 2 | 33 mm |
| Example 1 | 1 | .38 | 1 | 5.8 mm |
| | 2 | .357 | 1 | 9.6 mm |

The performance results shown in Table 1 demonstrate that the device according to the invention is very efficient at dispersing and dampening impact forces transferred through a ballistic vest. In the case of the .38 caliber ammunition, the device according to the invention reduced the deformation by 67.4%. In the case of .357 caliber ammunition, the device according to the invention reduced the deformation by 70.9%. Thus, the device according to the invention provides substantial protection against blunt force trauma in ballistic vest applications. The device disperses and dampens impact forces directed at one side of the device such that deformation of a backing material is reduced by at least 50% as compared to when the device is not present when tested in accordance with the test method set forth in NIJ 0101.04.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept.

What is claimed is:

1. A device for dispersing and dampening impact forces comprising:

a first composite sheet structure including an innermost thermoplastic layer and at least one fibrous layer; and a second composite sheet structure including an innermost thermoplastic layer and at least one fibrous layer;

wherein the innermost thermoplastic layer of the first composite sheet structure is joined in direct contact with the innermost thermoplastic layer of the second composite sheet structure at a boundary zone such that an area bounded by the boundary zone defines a substantially gas-tight chamber having a first side corresponding to the first composite sheet structure and a second side corresponding to the second composite sheet structure, wherein the innermost thermoplastic layer of the first composite sheet structure is also joined in direct contact with the innermost thermoplastic layer of the second composite sheet structure around a perimeter of a plurality of ventilation holes provided through the first composite sheet structure and the second composite sheet structure within the area bounded by the boundary zone, wherein gaps between adjacent joints between the first composite sheet structure and the second composite sheet structure within the area bounded by the boundary zone subdivide the gas-tight chamber into fluid-connected pockets, wherein the volume of the substantially gas-tight chamber is at least about 5 $in^3$ but not greater than 500 $in^3$ when inflated to a pressure of 3 to 4 psi, wherein the substantially gas-tight chamber is inflated with a gas at a pressure within a predetermined range of acceptable pressures from about 1.5 to about 6 pounds per square inch, wherein the device has a predetermined maximum thickness when the gas-tight chamber is inflated within the predetermined range of acceptable pressures of from about 0.25" to about 0.5", and wherein outer surface contours of both the first composite sheet structure and the second composite sheet structure are non-planar within the area bounded by the boundary zone when the gas-tight chamber is inflated substantially;

wherein the plurality of ventilation holes provided through the first composite sheet structure and the second composite sheet structure within the area bounded by the boundary zone define an opening having a diameter of from about 0.125" to about 0.25" and are bounded by a perimeter joint between the first composite sheet structure and the second composite sheet structure having a width of from about 3/32" to about 3/16";

wherein the gaps between adjacent joints between the first composite sheet structure and the second composite sheet structure within the area bounded by the boundary zone are a maximum of from about 0.4" to about 0.5".

2. The device according to claim 1 further comprising a hand pump for inflating the substantially gas-tight chamber with the gas.

3. The device according to claim 1 further comprising a gas pressure indicator for indicating the pressure of the gas in the substantially gas-tight chamber.

4. The device according to claim 1 further comprising a plurality of discontinuous weld seams, wherein the plurality of discontinuous weld seams join the first composite sheet structure in direct contact with the second composite sheet structure within the area bounded by the boundary zone.

5. The device according to claim 4 wherein the plurality of ventilation holes and the plurality of discontinuous weld seams are arranged in a series of parallel lines.

6. The device according to claim 1, wherein the device is positioned between an armor portion of a ballistic vest and a torso portion of the wearer, and wherein the device disperses and dampens impact forces transferred through the ballistic vest by projectiles that strike but do not penetrate the armor portion of the ballistic vest.

7. The device according to claim 6 wherein the device is disposed within a pouch on an inner side of the ballistic vest.

8. The device according to claim 6 wherein the device is secured to an inner side of the ballistic vest.

9. The device according to claim 6 wherein the device is secured to an article of clothing adapted to be worn by a human beneath the ballistic vest.

10. The device according to claim 6 wherein the device is configured to be worn as a vest by a human beneath the ballistic vest.

11. The device according to claim 6 wherein the device further comprises a hand pump for inflating the substantially gas-tight chamber with the gas.

12. The device according to claim 6 wherein the device further comprises a gas pressure indicator for indicating the pressure of the gas in the substantially gas-tight chamber.

13. The device according to claim 6 wherein the device further comprises a plurality of discontinuous weld seams, wherein the plurality of discontinuous weld seams join the first composite sheet structure in direct contact with the second composite sheet structure within the area bounded by the boundary zone.

14. The device according to claim 13 wherein the plurality of ventilation holes and the plurality of discontinuous weld seams are arranged in a series of parallel lines.

15. The device according to claim 14, wherein each ventilation hole in the parallel lines is spaced about 1" apart from an adjacent ventilation hole in the parallel lines, and wherein the parallel lines are offset such that the ventilation holes are spaced apart about 1 7/8" from the nearest two ventilation holes in the next adjacent parallel line.

16. The device according to claim 15, wherein the parallel lines of discontinuous weld seams are arranged in the spaces between the plurality of ventilation holes to create a pattern in which the maximum gap between adjacent joints between the first composite sheet structure and the second composite sheet structure within the area bounded by the boundary zone are a maximum of from about 0.4" to about 0.5".

17. The device according to claim 6 wherein the device further comprises an active or passive cooling member.

18. The device according to claim 1, wherein the gaps between adjacent joints between the first composite sheet structure and the second composite sheet structure within the area bounded by the boundary zone are a maximum of from about 0.4" to about 0.5".

* * * * *